US005549495A

United States Patent [19]

Burnworth et al.

[11] Patent Number: 5,549,495

[45] Date of Patent: Aug. 27, 1996

[54] SIDE ENTRY LIFE VEST

[75] Inventors: Scott Burnworth, El Cajon; Phillip L. Johnson, Carlsbad, both of Calif.

[73] Assignee: Extreme Sports, Inc., Carlsbad, Calif.

[21] Appl. No.: 383,592

[22] Filed: Feb. 3, 1995

[51] Int. Cl.[6] ..... B63C 9/115

[52] U.S. Cl. ..... 441/108; 441/115

[58] Field of Search ..... 441/106, 108, 441/113, 114, 115, 116, 117, 118

[56] References Cited

U.S. PATENT DOCUMENTS

| | | | |
|---|---|---|---|
| 1,200,858 | 10/1916 | Linder | 441/115 |
| 2,132,544 | 10/1938 | Shaw | 441/115 |
| 3,727,249 | 4/1973 | Bonthelius | 441/118 |
| 4,496,328 | 1/1985 | Asher et al. | 441/115 |
| 4,871,338 | 10/1989 | Hoffman | 441/115 |

OTHER PUBLICATIONS

Jet Pilot Catalog (1993), "V3 Impactor" Life Vest Illustrated.

*Primary Examiner*—Sherman Basinger

*Attorney, Agent, or Firm*—Brown, Martin, Haller & McClain

[57] ABSTRACT

A side entry life vest has buckles disposed on the ventral panel and belts retained in horizontal tubes formed in the dorsal panel. The likelihood that a wearer may don the vest backwards is minimized because the buckles would be beyond the person's comfortable reach, and the person would immediately sense that the vest is backwards. The belts extend substantially the entire width of the dorsal panel and both maximize belt retention strength and provide a flat area on which to display a sponsor's name, logo or other information.

12 Claims, 2 Drawing Sheets

FIG.

SIDE ENTRY LIFE VEST

BACKGROUND OF THE INVENTION

The present invention relates to personal flotation devices of the type generally known as life vests. A life vest comprises a body portion that is typically either formed essentially of a buoyant material or has a fabric shell filled with a buoyant material. A life vest also comprises a means for securing the body on a wearer's torso, such as one or more belts and associated buckles.

In high speed watersports, such as jet boat racing, side entry life vests are used more commonly than the front entry life vests used in recreational boating. Side entry life vests are defined by a ventral panel that covers the wearer's chest and a dorsal panel that covers the wearer's back. The term "panel" is used for convenience, and a panel does not necessarily correspond to any specific construction. The dorsal and ventral panels are connected along one edge, thereby forming a generally V-shaped or U-shaped structure. The unconnected edges of the panels define an entry opening into which a person inserts his torso from a lateral direction to don the vest. The vest may also have a top panel or straps to support the vest on the wearer's shoulders.

The ventral panel of a side entry life vest can be more fully padded with buoyant material than a conventional front entry vest to better maintain a wearer floating face-up in the water if the wearer is unconscious. The additional padding may also protect the wearer against the shock of an impact with the water; boat speeds in watersports such as jet boat racing may reach 75 miles per hour or more. In addition, side entry life vests are more easily donned and removed than the more conventional front entry vests. It is important that a life vest be quickly and easily removable from an injured wearer.

Although side entry life vests provide many advantages to boat racers that front entry life vests do not, they suffer the disadvantage that a person can inadvertently don the vest backwards because the ventral and dorsal panels are typically similar in appearance. Further adding to the potentially confusing symmetry, the buckles of side entry vests are typically located across the side entry opening of the vest.

Life vests used in high speed watersports typically are more heavily reinforced than life vests for recreational boating to prevent them from being torn off the wearer's body during an accident. In particular, the belt loops may be reinforced to aid retention of the belt on the vest during a high-speed accident. Nevertheless, there is a need in the art for more secure retention of the belts.

Racers in land-based sports may wear jackets that bear the name of a sponsor. Racers in water-based sports, however, cannot easily attach a sponsor's name or logo to their life vests because the vests have few flat areas on which such indicia can be imprinted or otherwise attached. For example, the dorsal and ventral panels of a side entry vest has several belt loops, between which sections of the belts are exposed.

These problems and deficiencies are clearly felt in the art and are solved by the present invention in the manner described below.

SUMMARY OF THE INVENTION

The present invention comprises a side entry life vest having buckles disposed on the ventral panel and a novel reinforcement means for the belts.

The likelihood that a wearer will don the vest backwards is minimized because the buckles would be beyond the person's comfortable reach, and the person would thus immediately sense that the vest is backwards.

The belts are retained in horizontal tubes integrally formed in the dorsal panel of the vest and extending substantially the entire width of that panel. The tubes maximize belt retention strength because their surface areas and areas of attachment to the remainder of the dorsal panel are larger than those of belt loops in prior art side entry life vests. In addition, the tubes form a flat area on the dorsal side of the vest that can be used to display a sponsor's name, logo or other information. The belts may have quick-release buckles to further facilitate donning and removal.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
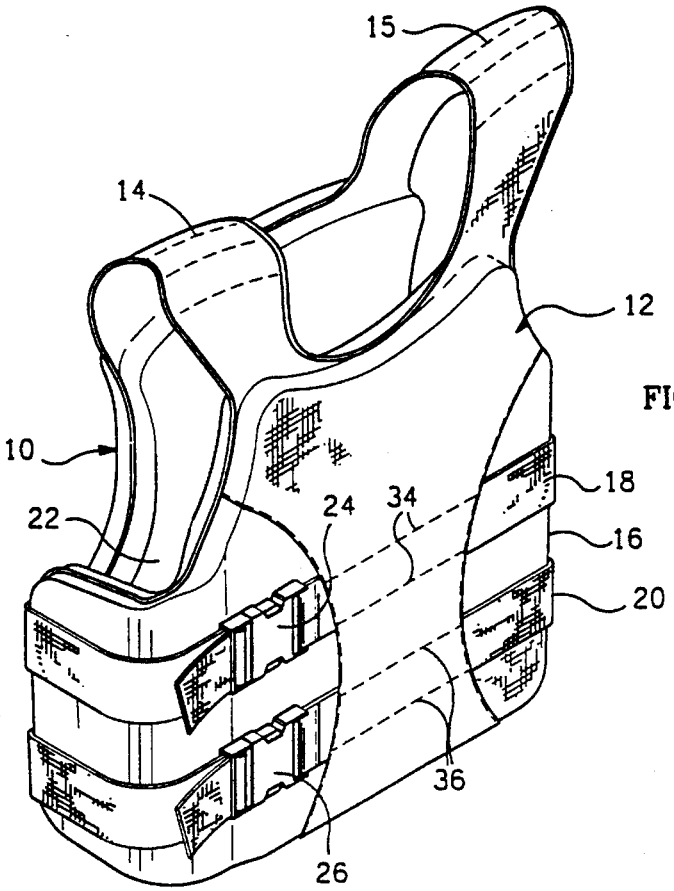
FIG. 1 is a perspective view of the vest.

As illustrated in FIGS. 1–5, a side entry life vest comprises a dorsal panel 10 joined to a ventral panel 12. Dorsal panel 10 is joined to ventral panel 12 at the top of the vest by two shoulder portions 14 and 15 that together define a top panel having an opening through which a wearer's head (not shown) may extend. Dorsal and ventral panels 10 and 12 are joined at the left-hand side 16 of the vest by two belts 18 and 20, which are made of a suitable material such as polypropylene webbing. The right-hand side 22 of the vest defines a side opening between panels 10 and 12 through which a wearer may place his torso (not shown) to enter or exit the vest. When belts 18 and 20 are unfastened, as described below, the vest has a general U-shape or V-shape, with the open right-hand side 22 defining the adjacent ends of the "U" or "V" and with the closed left-hand side 16 of the vest defining the vertex of the "U" or "V".

Buckles 24 and 26 are connected to the ends of belts 18 and 20, respectively. Buckles 24 and 26 are preferably of the snap-in quick-release type and preferably have belt-length adjustors.

Figure 2:
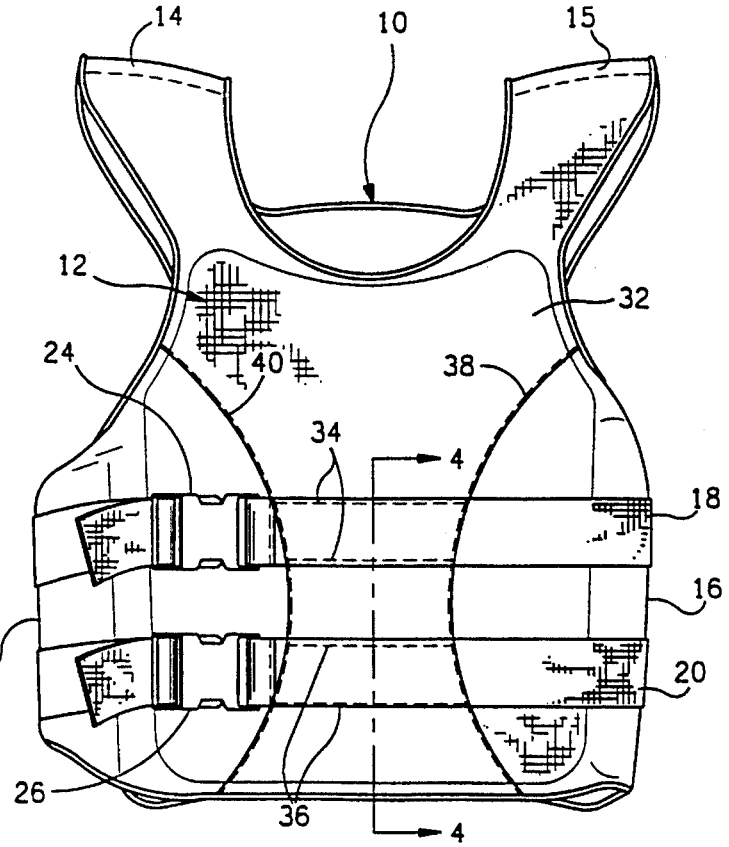
FIG. 2 is an elevational view of the ventral side of the vest.
Figure 4:
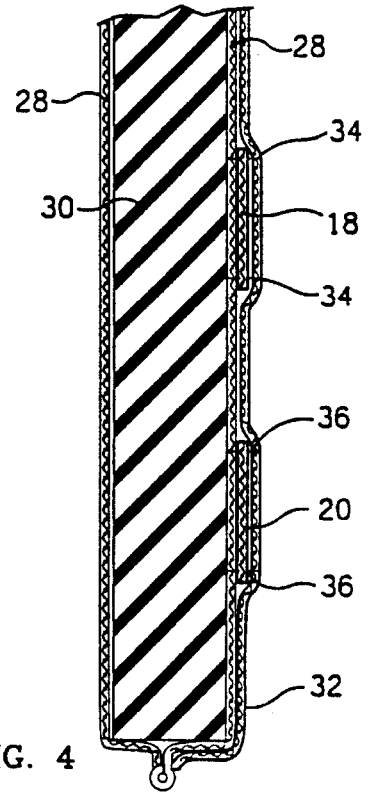
FIG. 4 is a sectional view taken on line 4—4 of FIG. 2.

As illustrated in FIGS. 2 and 4, ventral panel 12 comprises a ventral shell or inner envelope 28 made of a suitable material such as nylon enclosing a ventral panel core 30 made of a suitable buoyant material such as foamed flexible poly-vinyl chloride (FPVC). Belts 18 and 20 are sewn between ventral inner envelope 28 and a ventral outer envelope 32 along ventral belt seams 34 and 36, respectively. Seams 34 and 36 join belts 18 and 20 to both ventral envelopes 28 and 32 and thus securely retain belts 18 and 20 on the vest. The relatively long length of ventral belt seams 34 and 36 in comparison to conventional belt loops maximizes belt retention strength. Outer envelope 32 is sewn onto inner envelope 28 along left-hand ventral seam 38 and right-hand ventral seam 40.

Buckles 24 and 26 are disposed immediately adjacent right-hand ventral seam 40. Buckles 24 and 26 are within easy reach of a wearer when the vest is properly donned, but a wearer who has donned the vest backwards would immediately sense such because buckles 24 and 26 would be behind him and thus out of his comfortable reach. The vest thus minimizes the likelihood of a person donning it improperly.

Figure 3:
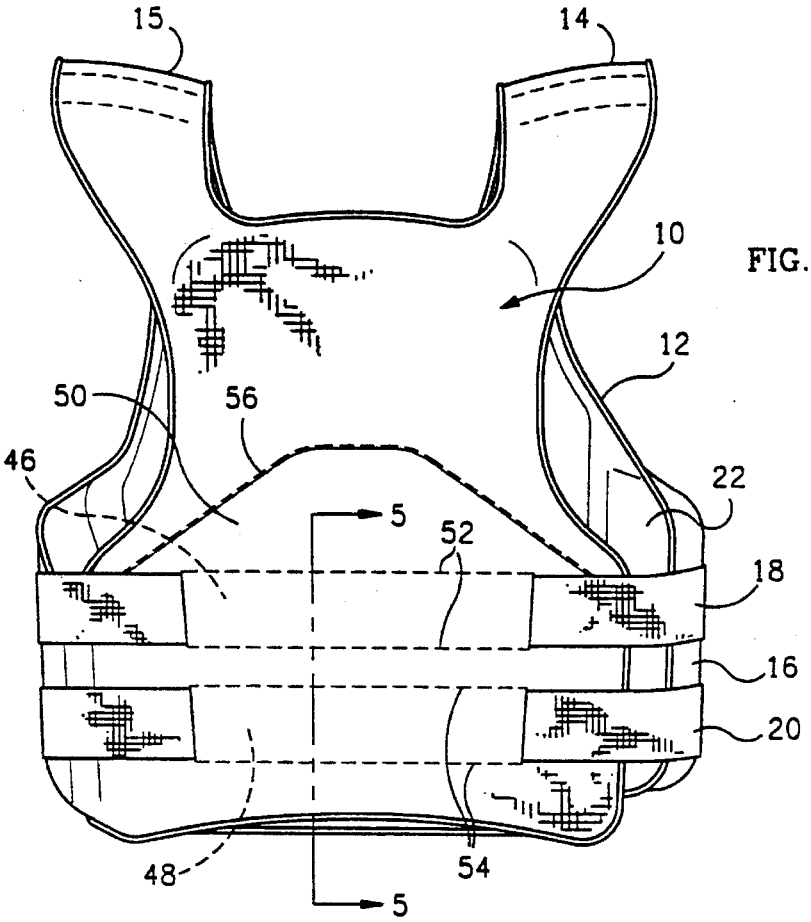
FIG. 3 is an elevational view of the dorsal side of the vest.
Figure 5:
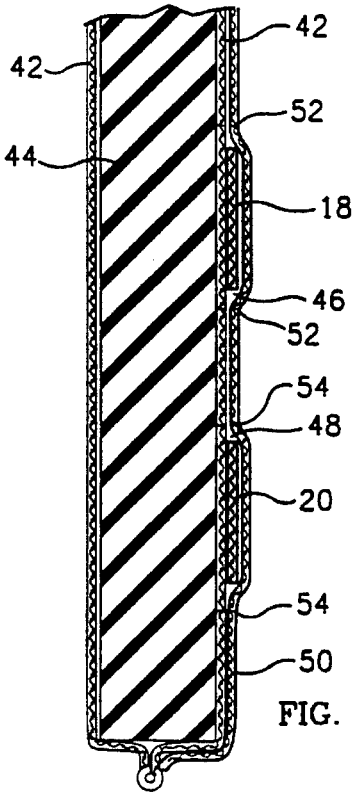
FIG. 5 is a sectional view taken on line 5—5 of FIG. 3.

As illustrated in FIGS. 3 and 5, dorsal panel 10 comprises a dorsal inner envelope 42 made of the same material as ventral inner envelope 28 and enclosing a dorsal panel core 44 made of the same buoyant material as ventral panel core 30. Belts 18 and 20 are retained in two channels or belt tubes 46 and 48, respectively, sewn between dorsal inner envelope 42 and a dorsal outer envelope 50 along dorsal belt tube seams 52 and 54, respectively. Belts 18 and 20 can slide within belt tubes 46 and 48 to facilitate belt length adjustment. The relatively long length of dorsal belt tube seams 52 and 54 in comparison to conventional belt loops maximizes belt retention strength. Dorsal outer envelope 50 is sewn onto dorsal inner envelope 42 along dorsal seam 56. In addition to maximizing belt retention strength, the relatively long length of dorsal belt tube seams 52 and 54 (and thus the relatively long length of belt tubes 46 and 48) provides a substantially flat area that extends substantially across the entire width of dorsal panel 10. Indicia, such as the name or logo of a racer's sponsor, may be placed or imprinted on the flat area in any suitable manner.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A life vest, comprising:

a body portion having a ventral panel, a dorsal panel, and a top panel, said ventral and dorsal panels each having an upper edge, a lower edge and two side edges, one side edge of said ventral panel adjoining one side edge of said dorsal panel, the other side edges of said ventral and dorsal panels defining an opening therebetween for receiving a wearer's torso, said top panel having a ventral edge, a dorsal edge and an opening for receiving a wearer's head, said ventral edge of said top panel adjoining said upper edge of said ventral panel, said dorsal edge of said top panel adjoining said upper edge of said dorsal panel, said dorsal panel having a first integrally formed elongated tube extending across said dorsal panel;

a first belt having two first belt ends, said first belt adjustably extending through said first elongated tube, a portion of said first belt extending across said ventral panel and fixedly attached to said ventral panel along an elongated attachment area; and a first buckle having two interengageable first buckle halves, each attached to one of said first belt ends.

2. The life vest claimed in claim 1, wherein one said first belt end is fixedly attached to said ventral panel.

3. The life vest claimed in claim 2, wherein said first buckle has a resilient actuator for quickly releasing said first buckle halves from interengagement.

4. The life vest claimed in claim 1, wherein:

said dorsal panel has a second elongated tube extending across said dorsal panel parallel to said first elongated tube; and said life vest further comprises:

a second belt having two second belt ends, said second belt extending through said second elongated tube, a portion of said second belt extending across said ventral panel and attached to said ventral panel; and a second buckle having two interengageable halves, each attached to one of said second belt ends.

5. The life vest claimed in claim 4, wherein one said second belt end is disposed adjacent said ventral panel.

6. The life vest claimed in claim 5, wherein said second buckle has a resilient actuator for quickly releasing said first buckle halves from interengagement.

7. A life vest, comprising:

a U-shaped body portion having a dorsal panel and a ventral panel connected along an edge;

a top body portion for retaining said U-shaped body portion on a wearer's shoulders, said dorsal panel having a first integrally formed elongated tube extending across said dorsal panel, said dorsal panel defining a generally flat continuous surface;

a first belt having two first belt ends, said first belt adjustably extending through said first elongated tube, a portion of said first belt extending across said ventral panel and fixedly attached to said ventral panel along an elongated attachment area; and a first buckle having two interengageable first buckle halves, each attached to one of said first belt ends.

8. The life vest claimed in claim 7, wherein one said first belt end is fixedly attached to said ventral panel.

9. The life vest claimed in claim 8, wherein said first buckle has a resilient actuator for quickly releasing said first buckle halves from interengagement.

10. The life vest claimed in claim 7, wherein:

said dorsal panel has a second integrally formed elongated tube extending across said dorsal panel parallel to said first elongated tube; and said life vest further comprises:

a second belt having two second belt ends, said second belt extending through said second elongated tube, a portion of said second belt extending across said ventral panel and attached to said ventral panel; and a second buckle having two interengageable halves, each attached to one of said second belt ends.

11. The life vest claimed in claim 10, wherein one said second belt end is disposed adjacent said ventral panel.

12. The life vest claimed in claim 11, wherein said second buckle has a resilient actuator for quickly releasing said first buckle halves from interengagement.

* * * * *